US009644892B2

(12) United States Patent
Peterson

(10) Patent No.: US 9,644,892 B2
(45) Date of Patent: May 9, 2017

(54) INTERNAL STAGED SUPPRESSION SYSTEM

(71) Applicant: Custom Dryer Suppression System, LLC, Napoleon, OH (US)

(72) Inventor: Wesley L. Peterson, Indianapolis, IN (US)

(73) Assignee: CUSTOM DRYER SUPPRESSION SYSTEM, LLC, Napoleon, OH (US)

( * ) Notice: Subject to any disclaimer, the term of this patent is extended or adjusted under 35 U.S.C. 154(b) by 479 days.

(21) Appl. No.: 14/181,289

(22) Filed: Feb. 14, 2014

(65) Prior Publication Data

US 2014/0223756 A1 Aug. 14, 2014

Related U.S. Application Data

(60) Provisional application No. 61/764,662, filed on Feb. 14, 2013.

(51) Int. Cl.
*F26B 19/00* (2006.01)
*F26B 21/08* (2006.01)
*F26B 17/16* (2006.01)

(52) U.S. Cl.
CPC ..... *F26B 21/08* (2013.01); *F26B 17/16* (2013.01); *F26B 2200/06* (2013.01)

(58) Field of Classification Search
CPC ..... A62C 3/002; A62C 3/004; A62C 3/008; A62C 3/0214; A62C 3/0221; A62C 3/065; A62C 31/02; A62C 3/00; F24C 15/20; F24C 15/2057; F26B 23/028; F26B 11/04; F26B 11/0436; F26B 17/122; F26B 19/005; F26B 1/005; F26B 2200/02; F26B 2200/24; F26B 25/002; F26B 25/007; F26B 3/08
See application file for complete search history.

(56) References Cited

U.S. PATENT DOCUMENTS 4,149,844 A * 4/1979 Noyes ..... F26B 17/122 34/174
2003/0106944 A1* 6/2003 Doppelt ..... A47J 37/0786 239/65
2005/0001065 A1* 1/2005 Senecal ..... A62C 31/02 239/461

(Continued)

FOREIGN PATENT DOCUMENTS

CN 2489810 Y 5/2002
DE 102009018501 A1 * 10/2010 ..... A62C 3/002

(Continued)

OTHER PUBLICATIONS

Wu translation.*

(Continued)

*Primary Examiner* — Jason Lau
(74) *Attorney, Agent, or Firm* — MacMillan, Sobanski & Todd, LLC

(57) ABSTRACT

An internal staged suppression system for suppressing a hazard occurring in a grain dryer includes a plurality of vertical column sections and at least one spray head positioned radially inward within the interior of the grain dryer. The spray head includes a deflector cap that generates a substantially horizontal spray of water sufficient to reach the walls defining the grain columns.

2 Claims, 12 Drawing Sheets

(56) References Cited

U.S. PATENT DOCUMENTS

2010/0266396 A1* 10/2010 Thut ..... F04D 29/628
415/200

FOREIGN PATENT DOCUMENTS

GB 632713 A * 12/1949 ..... A62C 31/02
RU WO 2011105926 A1 * 9/2011 ..... A62C 3/065

OTHER PUBLICATIONS

Preventing and Responding to Grain-Dryer Fires, Chuck Kunisch, 2012 (4 pages).
Internal Riser Pipe, Michigan Ag Commodities (10 pages).

* cited by examiner

INTERNAL STAGED SUPPRESSION SYSTEM

CROSS-REFERENCE TO RELATED APPLICATIONS

This application claims the benefit of U.S. Provisional Application No. 61/764,662, filed Feb. 14, 2013, the disclosure of which is incorporated herein by reference.

TECHNICAL FIELD

The invention relates generally to grain dryers. More specifically, the invention is directed to an internal staged suppression system for suppressing a hazard occurring in a grain dryer.

BACKGROUND OF THE INVENTION

Hazards that may occur in a grain dryer, such as a dust explosion, fire, or other such events, are difficult to suppress because the grain and the attendant hazard are contained within the dryer. Some of these hazards may be fought by spraying water on the exterior of the grain dryer. This, however, does little to suppress the hazard at its source, i.e., within the dryer. Thus, these hazards can frequently escalate in severity, ultimately resulting in the destruction of the dryer. It can also expose operators and firefighters to unpredictable safety hazards. The invention provides an efficient and economical internal staged suppression system for suppressing a hazardous event in a grain dryer.

BRIEF SUMMARY OF THE INVENTION

The invention is an internal staged suppression system for suppressing a hazardous event occurring in a grain dryer.

DETAILED DESCRIPTION OF THE INVENTION

Figure 1:
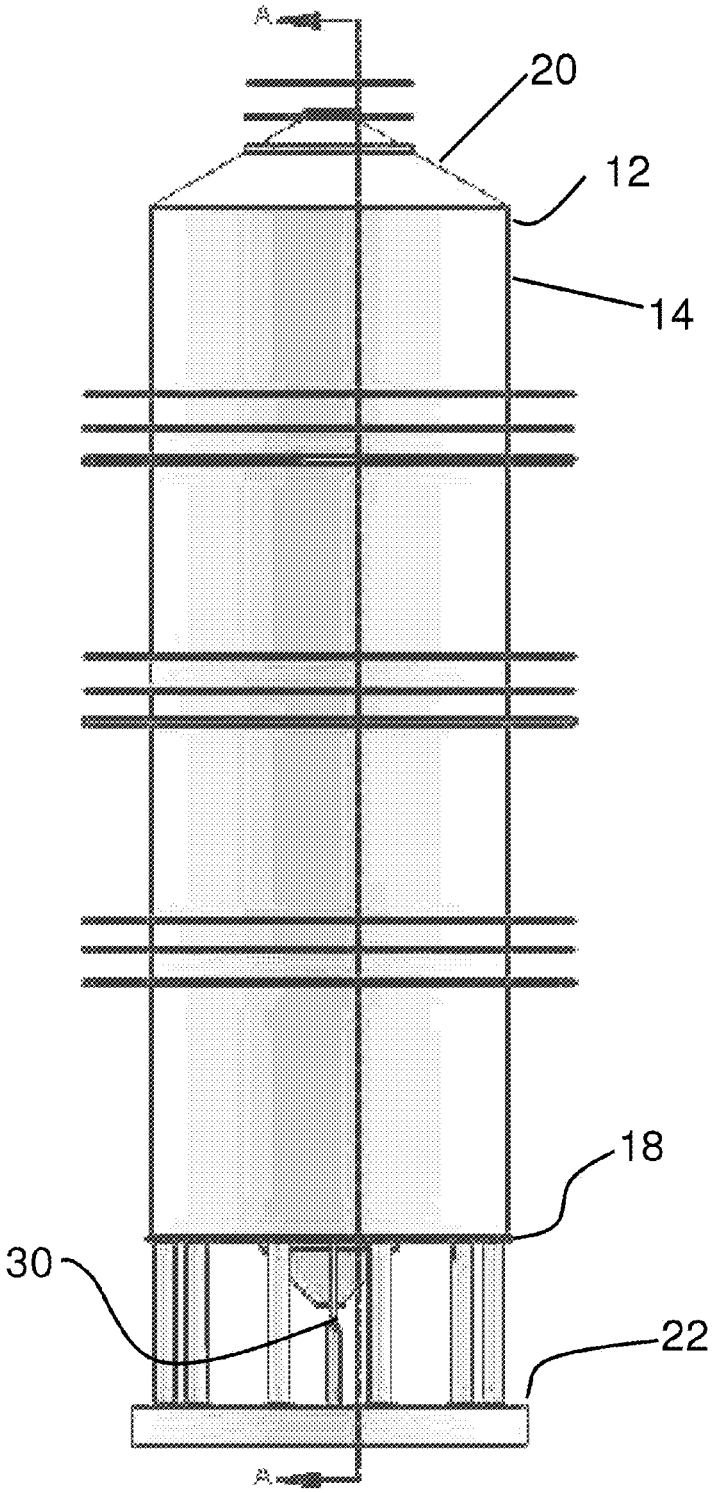
FIG. 1 is a front elevational view of a grain dryer in which the internal staged suppression system according to the invention is positioned.
Figure 2:
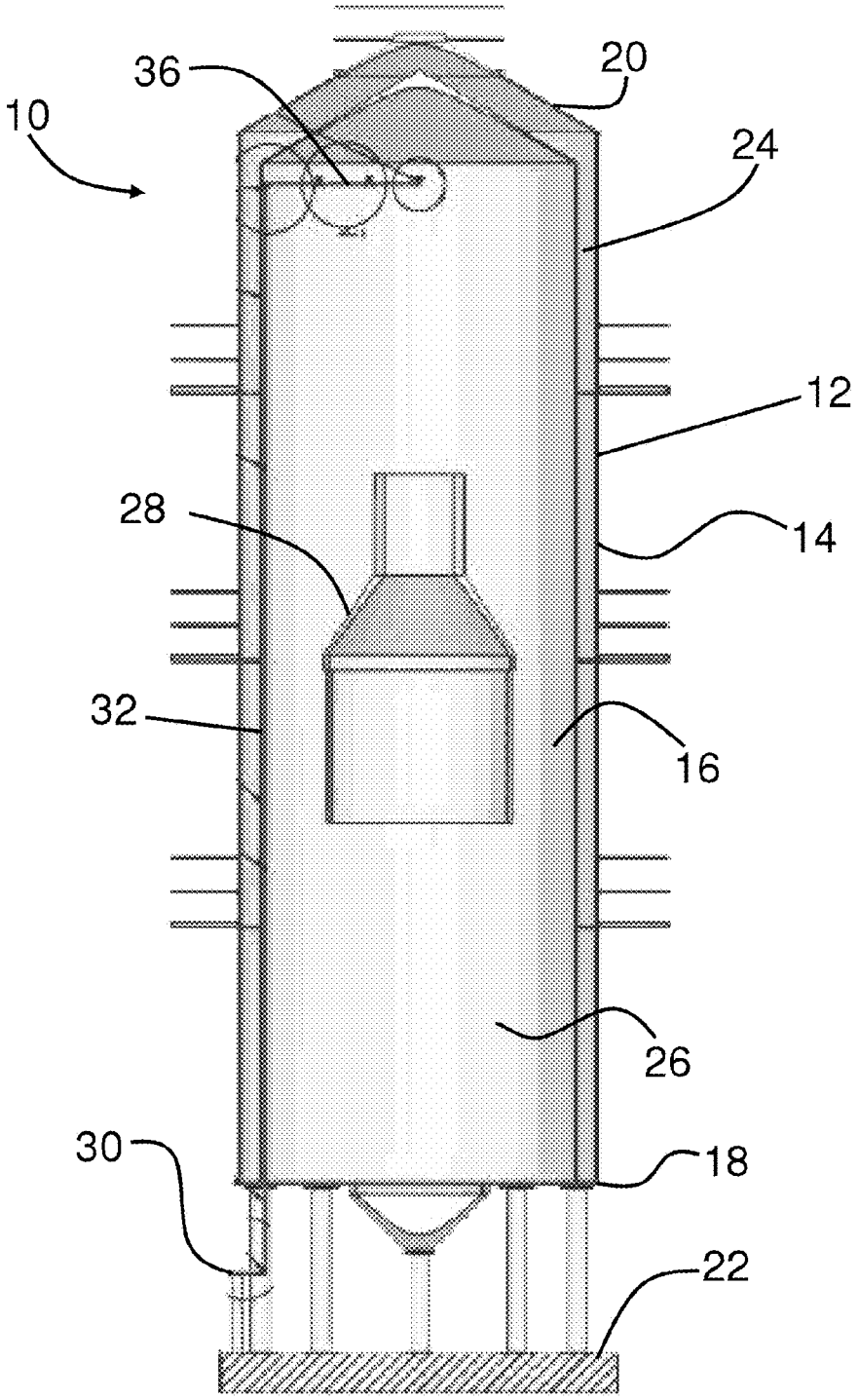
FIG. 2 is a cross-sectional view taken along line A-A of FIG. 1 showing the internal staged suppression system according to invention positioned in the grain dryer.
Figure 3:
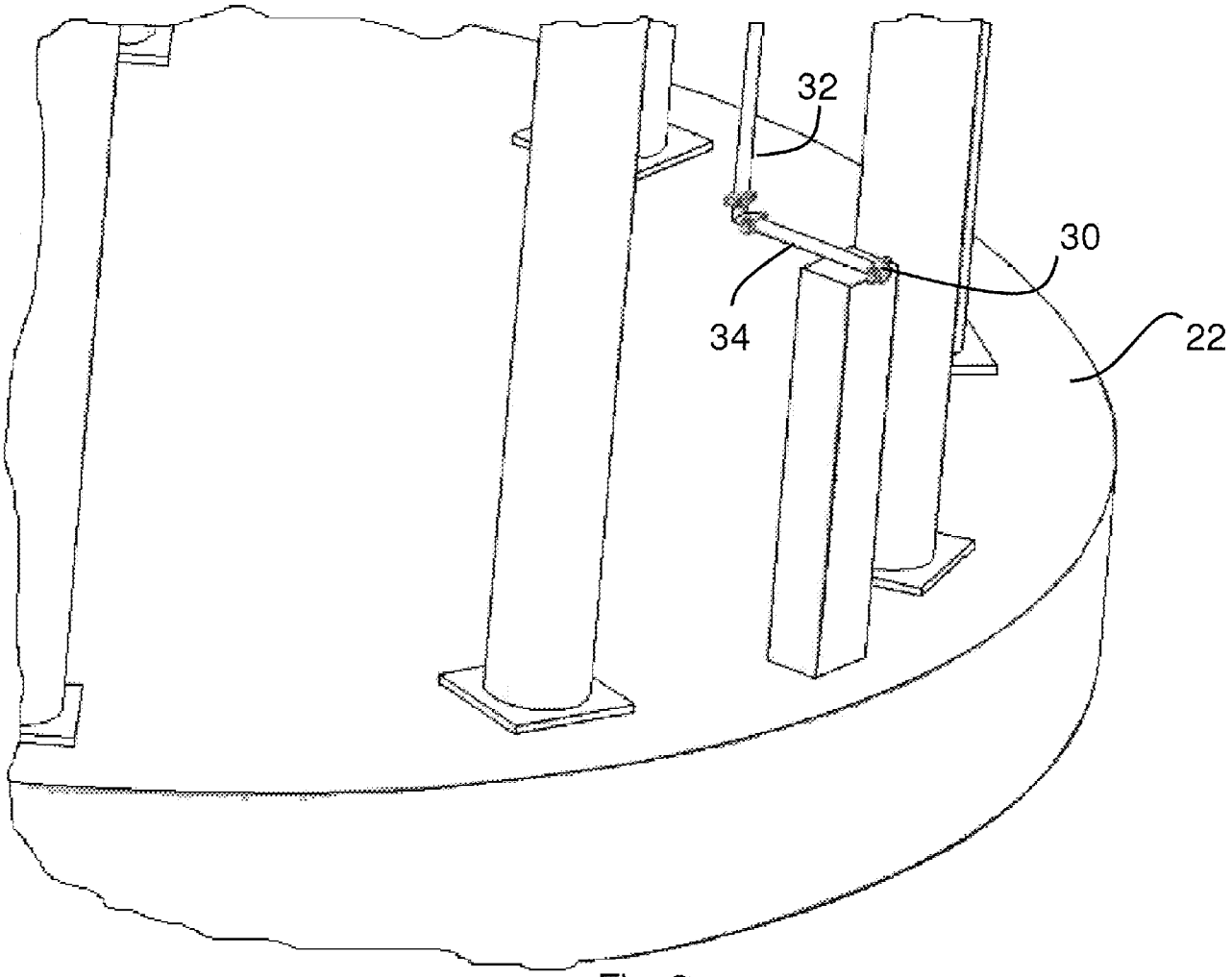
FIG. 3 is a detailed view of the inlet positioned on a dryer foundation according to the invention.

The invention will now be described in detail with reference being made to the drawings. The internal staged suppression system according to the invention is indicated generally in the drawing by the reference number "10." Referring to FIGS. 1 and 2, the internal staged suppression system 10 is utilized with a grain dryer 12 having an exterior 14, an interior 16, a bottom 18 and a top 20. The grain dryer 12 is positioned on a foundation 22 at the bottom 18. The interior 16 includes a grain column 24 for containing grain during drying and a heating section such as a heat plenum chamber 26 adjacent to the column 24. The grain column 24 is defined, in part, by the exterior 14 and the interior 16, which may be configured as perforated surfaces that permit heated air flow in order to dry the grain contained therein. The grain column 24 may be configured as a plurality of grain columns that are separated by walls extending between the exterior 14 and interior 16 of the grain dryer 12 and distributed around the perimeter thereof. The chamber 26 has a heating device such as a burner 28.

FIGS. 1-16 show an embodiment of the internal staged suppression system 10 according to the invention. As shown in FIGS. 1-5, the system 10 includes an inlet 30 positioned on or near the foundation 22. One or more vertical column sections 32, that are in fluid communication with the inlet 30 by a horizontal inlet section 34, extending from the bottom 18 to the top 20 through the interior 16 of the grain dryer 12. Though shown and illustrated in conjunction with the vertically oriented grain dryer 12, the various embodiments of the internal staged suppression system described herein are equally applicable to a horizontal grain dryer, which are known in the art.

Figure 11:
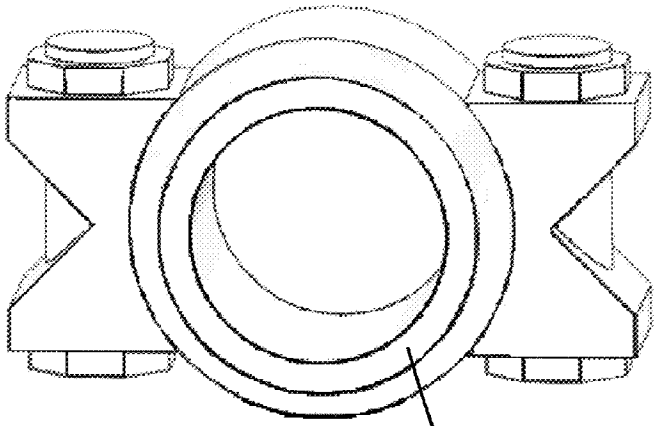
FIG. 11 is a perspective view of a groove coupler according to the invention.
Figure 12:
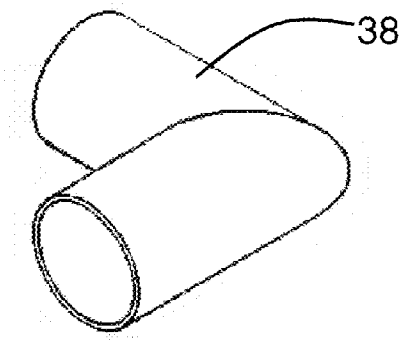
FIG. 12 is a perspective view of a 90° bend according to the invention.
Figure 13:
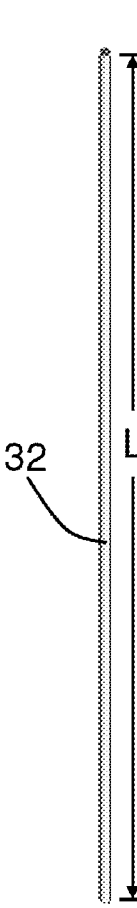
FIG. 13 is a perspective view of a vertical column section having a length L1 according to the invention.
Figure 14:
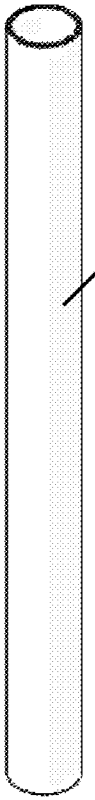
FIG. 14 is a perspective view of a horizontal inlet section according to the invention.
Figure 15:
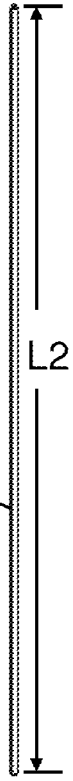
FIG. 15 is a perspective view of a vertical column section having a length L2 according to the invention.
Figure 16:
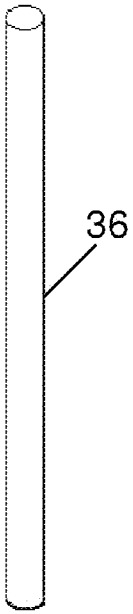
FIG. 16 is a perspective view of a horizontal column section according to the invention.

Referring to FIGS. 6-16, the system 10 includes one or more horizontal column sections 36 that are in fluid communication with the vertical column sections 32. The horizontal column sections 36 are in fluid communication with one or more bends 38. In an embodiment, the bends 38 are system specific. For example, the bends 38 can have configurations of about 90° (FIG. 12), along with other angular offsets, such as 18°, 22.5°, 30°, 45°, and any other suitable angles. As shown in FIGS. 6-10, the horizontal column sections 36 are arranged in a generally linear configuration and positioned at or near the top 20 of the grain dryer 12. The horizontal column sections 36 are in fluid communication with one or more outlets such as one or more high volume dispersion heads 40. In an embodiment, each head 40 has a head inlet 42 with a cap 44 to control the delivery of water in a generally horizontal pattern. In an embodiment, the cap 44 is capable of being lifted by pressurized water to a system specific clearance and then closed by gravity to seal the head 40. Each of the heads 40 is positioned on a head section 46. In the illustrated embodiment, the sections 32, 34, 36 and 46 are flanged. However, in another embodiment described below, the sections 32, 34, 36, and 46 may be assembled by way of conventional pipe threaded connections, including couplings, unions, elbows, tees, and any other suitable joints which are well known in the art of piping and plumbing. Thus, any reference made to grooved connections between components may also encompass or include threaded connections. As shown in FIGS. 5-9, the sections 32, 34, 36 and 46 and the bends 38 are coupled by one or more groove couplers 48 (FIG. 11).

In an embodiment, the vertical column sections 32, the horizontal inlet section 34, the horizontal column sections 36, the head sections 46 and the bends 38 are sized and adapted to carry a predetermined volume of pressurized suppression media, such as water, through the system 10. In an embodiment, the system 10 delivers a high volume of water in a generally horizontal pattern at substantial pressure to penetrate the grain column 24 as well as to saturate debris in the heat plenum chamber 26. In an embodiment, the system 10 locates one or more heads 40 in the center of the grain dryer 12 for substantially 360° delivery of water on a horizontal plane. In an embodiment, the system 10 delivers water to the grain dryer 12 at multiple levels.

The use of the internal staged suppression system 10 will now be described. Referring to FIGS. 1-9 pressurized water is delivered to the inlet 30 by a hose or other conduit (not shown) in response to a hazardous event occurring in the grain dryer 12. The water travels though the vertical column sections 32 to the horizontal column sections 36 and is discharged through the one or more heads 40 to suppress the fire. As it will be appreciated, the system 10 provides high-volume placement of water on demand to suppress a hazard event in a grain dryer 12 in an efficient and economical manner.

Figure 17:
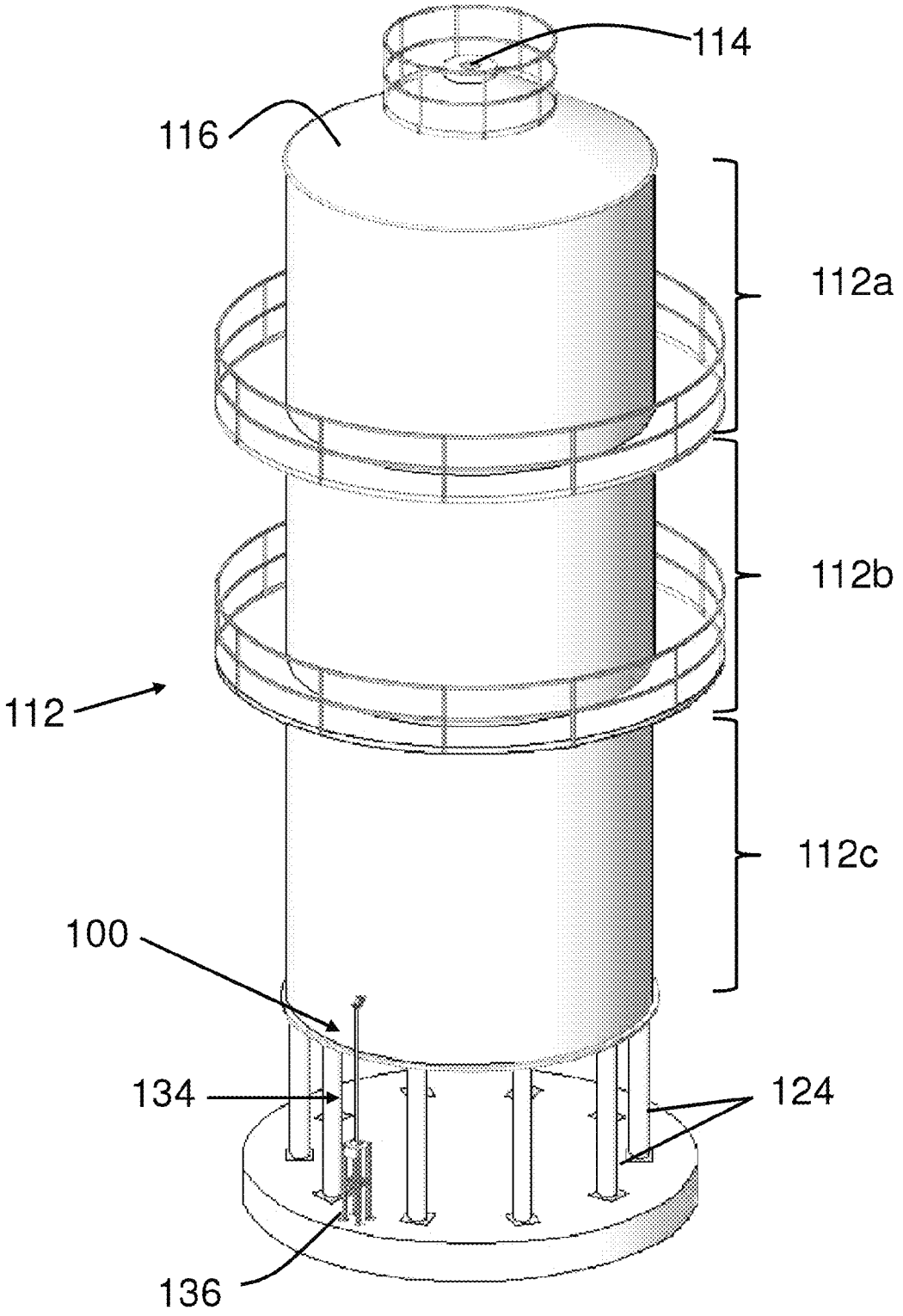
FIG. 17 is an alternative embodiment of a front elevational view of a grain dryer in which the internal staged suppression system according to the invention is positioned.
Figure 18:
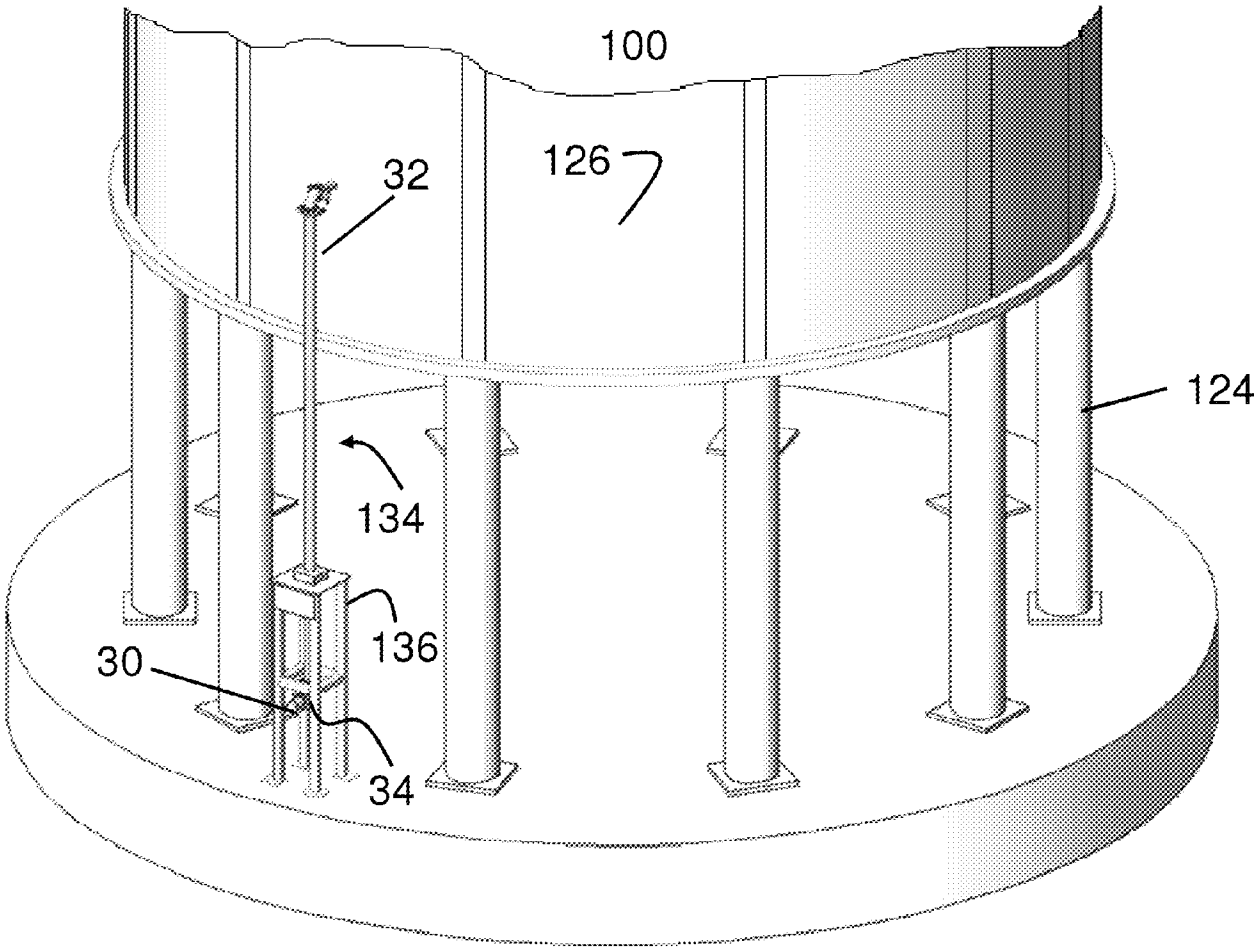
FIG. 18 is an enlarged portion of the grain dryer of FIG. 17 showing a detailed view of an inlet positioned on a dryer foundation according to the invention.
Figure 19:
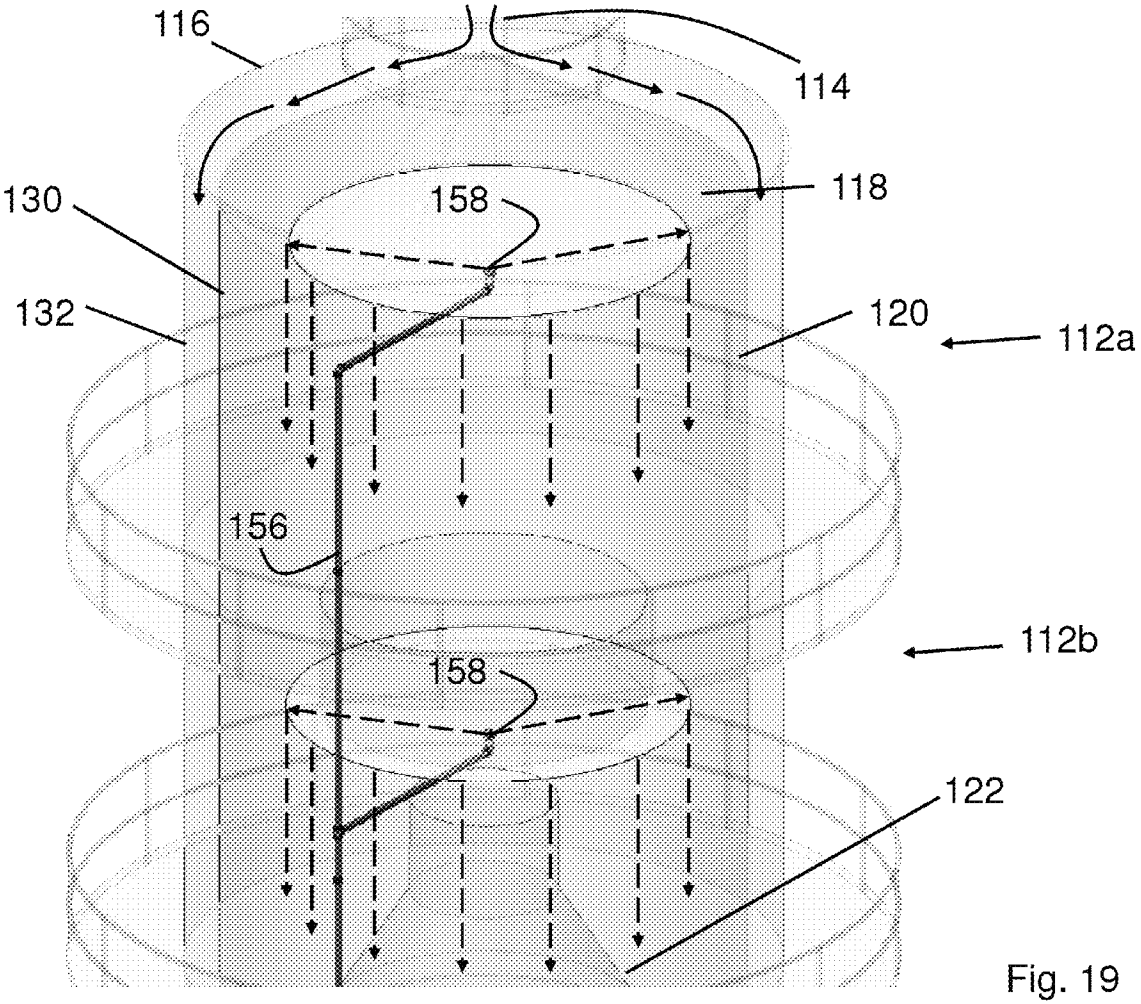
FIG. 19 is perspective view of another embodiment of a suppression system in a grain dryer (shown in phantom) and further depicting a suppression medium distribution pattern.

Referring now to FIGS. 17-19, there is illustrated another embodiment of an internal staged suppression system, shown generally at 100. The internal staged suppression system 100 may include portions that are similar to the internal staged suppression system 10 described above. The internal staged suppression system 100 is located within a grain dryer 112. The grain dryer 112 includes a top section 112*a*, a burner section 112*b*, and a cooling section 112*c*. Grain is admitted into the dryer 112 through a loading port 114 located at an outer top covering 116 of the dryer 112, as shown in FIG. 19. The grain flow, as indicated by the solid lines, over a top section 118 of a heated interior 120. The heated interior 120 includes a heat source, configured as a burner assembly 122, which is conventional in the art. The grain dryer 112 is supported by one or more support stanchions 124, typically located around the base. The stanchions 124 are typically situated under walls 126 that define individual grain columns 128, as shown in FIG. 18. The grain columns 128 are further defined by an exterior wall 130 and an interior wall 132, as shown in FIG. 19. The interior and exterior walls 130 and 132 may be perforated to permit heated air to flow through the grain stored in the grain columns 124.

Figure 5:
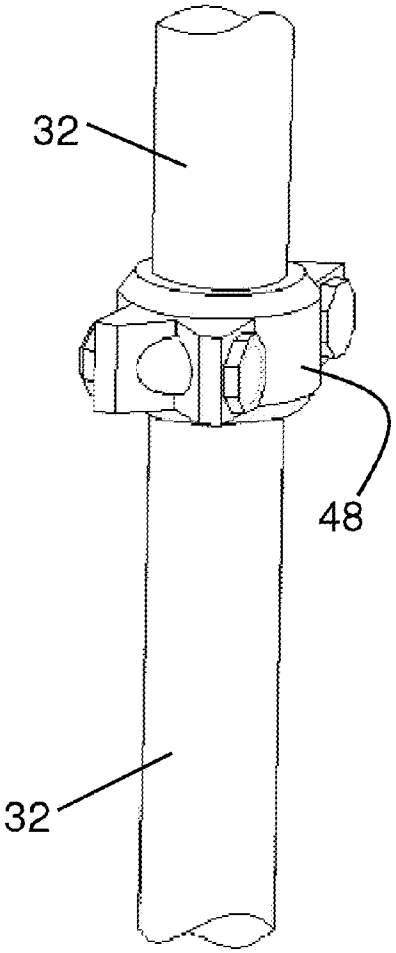
FIG. 5 is a detailed view of two vertical column sections and a groove coupler according to the invention.
Figure 4:
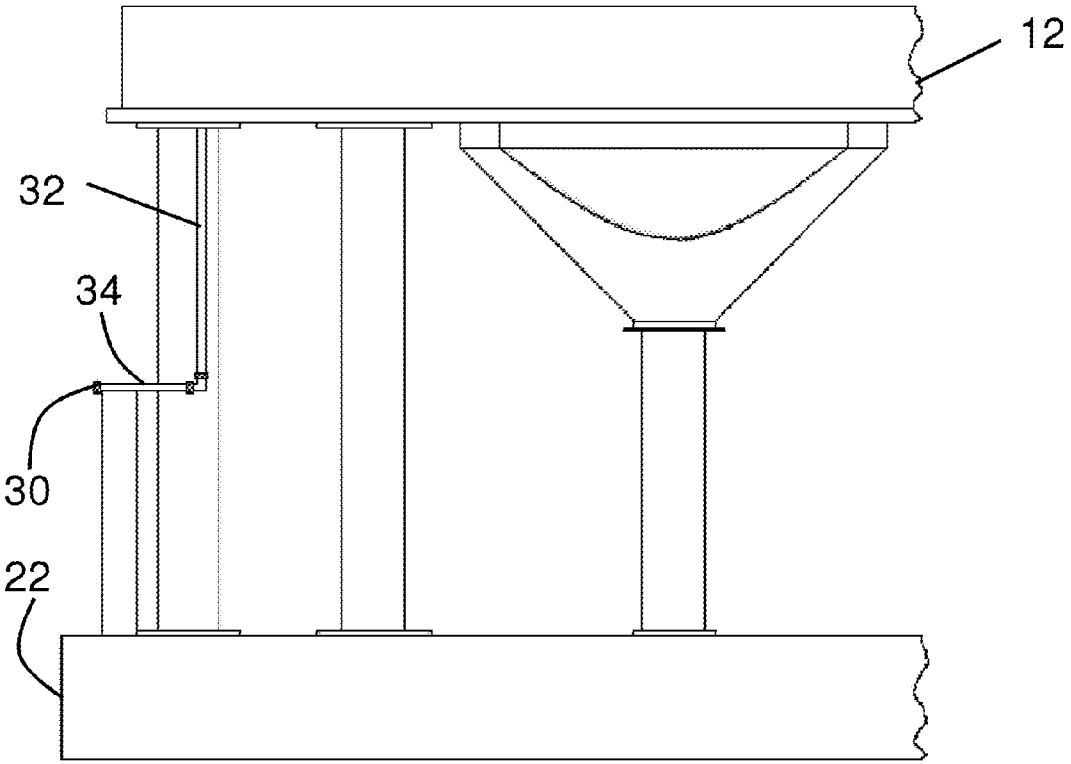
FIG. 4 is a side elevational view of the inlet according to the invention.
Figure 6:
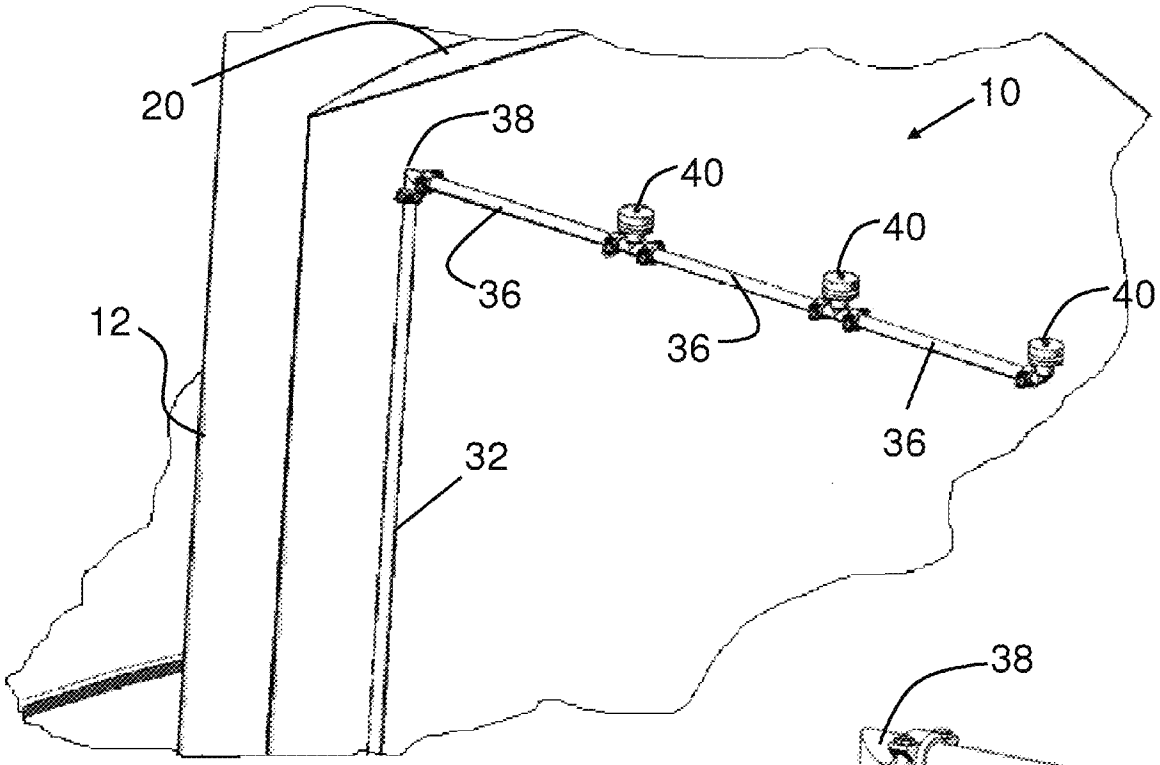
FIG. 6 is a is a detailed view of a vertical column section, a bend, three horizontal column sections, three dispersion heads, and groove couplers according to the invention.
Figure 7:
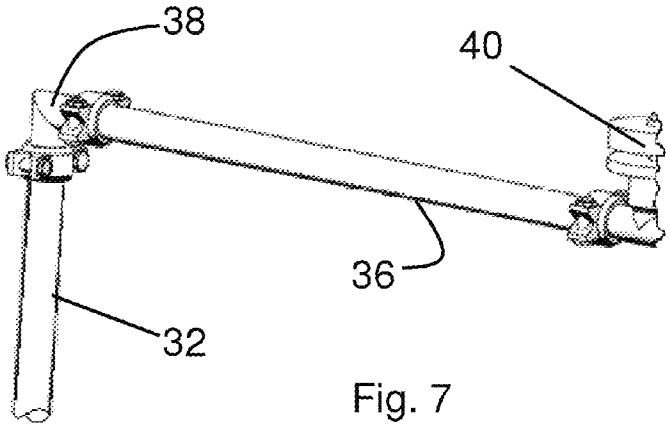
FIG. 7 is a is a detailed view of a vertical column section, a bend, a horizontal column section, a dispersion head, and groove couplers according to the invention.
Figure 8:
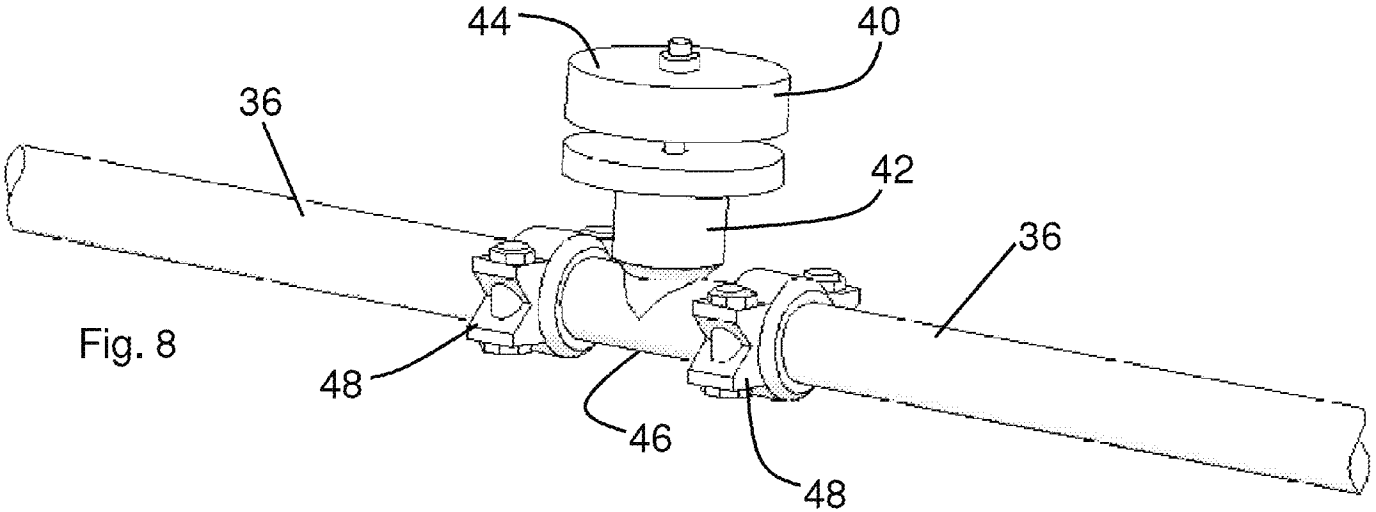
FIG. 8 is a detailed view of two horizontal column sections, a dispersion head, and groove couplers according to the invention.
Figure 9:
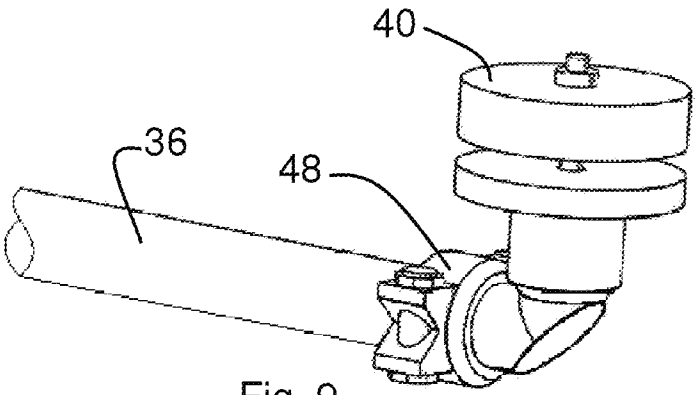
FIG. 9 is a detailed view of a horizontal column section, a dispersion head and a groove coupler according to the invention.
Figure 10:
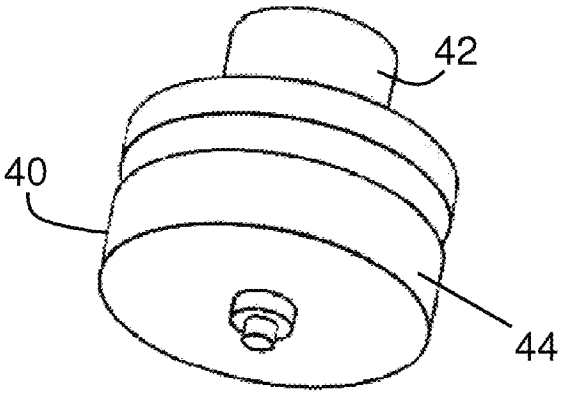
FIG. 10 is a perspective view of a dispersion head according to the invention.
Figure 25:
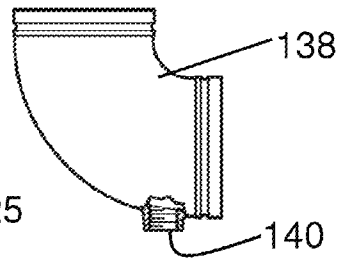
FIG. 25 is an elevational view, in partial cross section, of a drainable connecting elbow.

As is also shown in FIG. 18, an inlet section assembly, shown generally at 134, extends upwardly through a riser 136 and enters the grain dryer 112 through the exterior wall 132. The inlet section assembly 134 includes a one or more vertical column sections 32 that extend up through the riser 136. The vertical sections 32 are connected together by groove couplers 48, as shown in FIG. 5. A lower end of the inlet section assembly 134 extends below the riser 136 and terminates in a drainable connecting elbow 138, as shown in FIG. 25. The drainable connecting elbow 138 includes a drainage port 140 configured to accept a conventional valve (not shown) in order to evacuate water from the internal staged suppression system 100. The drainable connecting elbow 138 includes grooved ends 140 configured to mount by couplers 48 to the vertical sections 32 and horizontal inlet section 34. The horizontal inlet section 34 extends outwardly and terminates in the inlet 30. In one embodiment, the inlet 30 is configured to accept a Fire Department Connection (FDC) type connector such as, for example, a two simultaneous hose, or siamese, connection.

Figure 22:
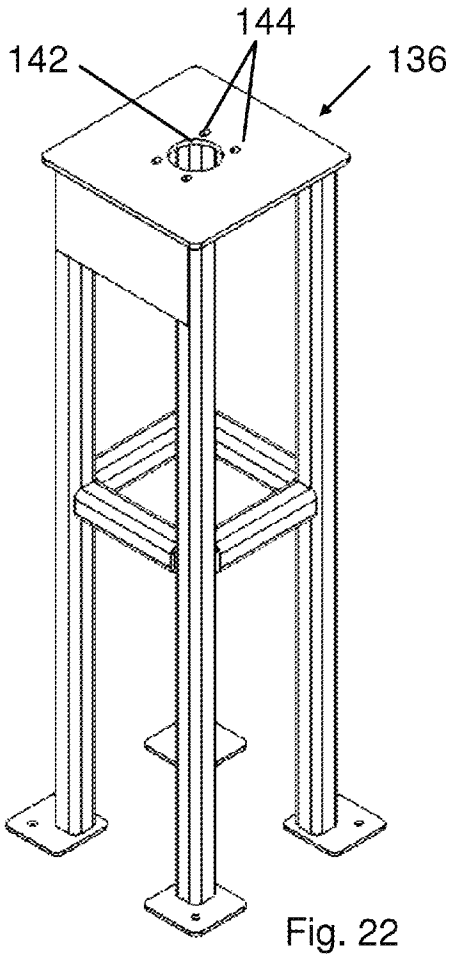
FIG. 22 is a perspective view of an embodiment of a riser stand.
Figure 24:
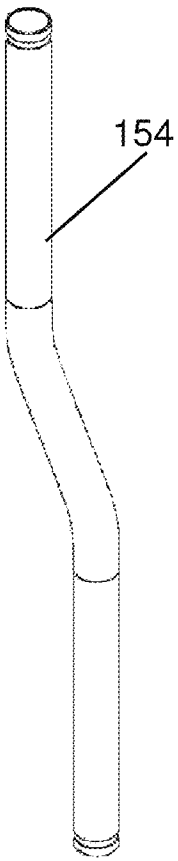
FIG. 24 is a perspective view of an embodiment of an offset supply tube.
Figure 23:
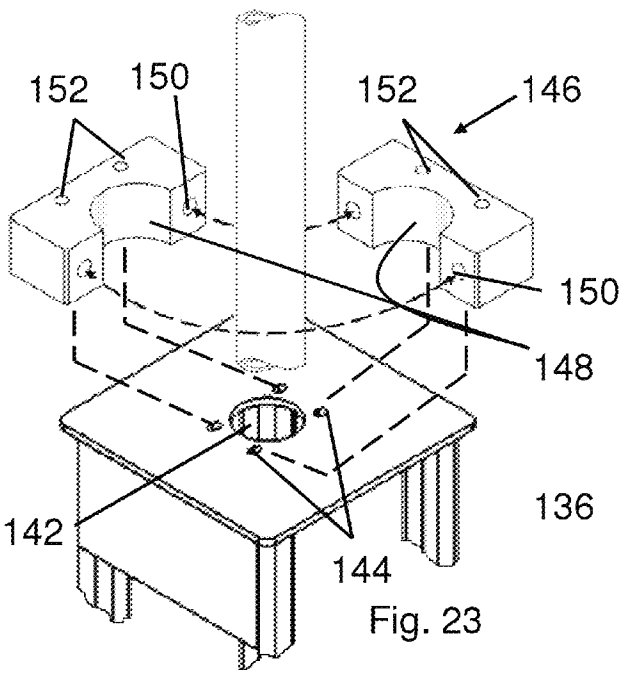
FIG. 23 is an exploded perspective view of an embodiment of a squeeze nut, as part of a riser support assembly.

Referring to FIGS. 22 and 23, the riser 136 is illustrated in detail. The riser 136 includes a column aperture 142 that permits the vertical section to pass therethrough. The riser 136 further includes mounting apertures 144 that are configured to fix a squeeze nut 146 to the riser. The squeeze nut 146 is formed in two generally similar halves. Each half includes arcuate cutouts 148, that are generally semi-circular cutouts, and clamping apertures 150 configured to fix the two halves of the squeeze nut 146 together. The clamping apertures 150 (and fasteners—not shown) permit the cutouts 148 of the squeeze nut 146 to clamp onto the pipe section such that the vertical column section 32 is fixed relative to the squeeze nut 146. The assembled squeeze nut 146 rests on top of the riser 136 and is attached by fasteners (not shown) extending through mounting holes 152 to the corresponding mounting apertures 144 on the riser 136. This attachment configuration permits length compensation of vertical column sections 32 relative to the foundation of the grain dryer 112. Since the suppression system 100 may be mounted when the grain dryer is empty, relaxing the clamp fit of the squeeze nut 146 when the dryer is filled with grain after system installation permits compensation of the deflections associated with the weight of grain bearing against and supported by the dryer. Thus, residual stresses that would otherwise be applied to the system can now be relaxed and reduced. In one embodiment, an offset column section 154, shown in FIG. 24, may extend through the riser 136 in order to clear obstacles, such as burner fuel feeds, grain discharge chute hatches or grain flow regulators, and the like.

Figure 20:
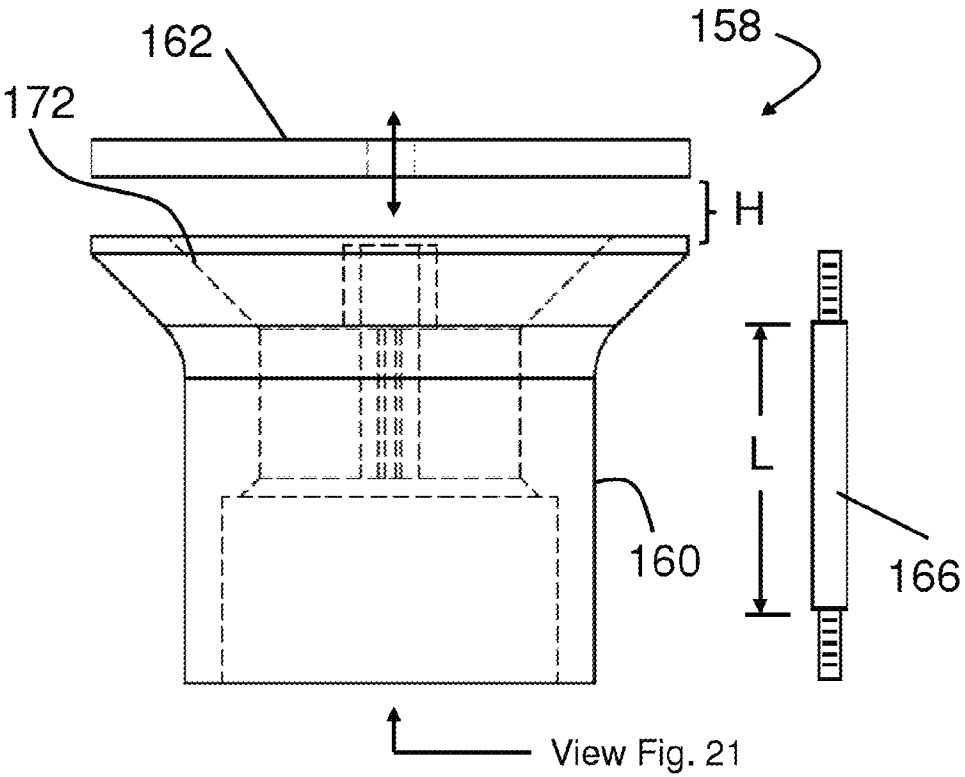
FIG. 20 is an elevational view of a spray head for use in a hazard suppression system in accordance with the invention.

Referring again to FIG. 19, the internal staged suppression system 100 is shown in a water discharge mode within the grain dryer 112, shown in phantom. In the embodiment shown in FIG. 19, water is delivered by vertical column sections 156, similar to vertical column sections 32 except having threaded end connections. In certain embodiments, the threaded connections inside the grain dryer 112 may provide a leak resistant connection during exposure to the heat output of the burner assembly 122. In the illustrated embodiment of FIG. 19, a single spray head 158 is located in the approximate radial center of two sections, the top section 112*a* and the burner section 112*b*, of the dryer 112. Alternatively, the spray heads may be located in any number and in any section or height position within the dryer 112. The spray head 158 is shown, in detail, in FIGS. 20 and 21.

The spray head 158 includes a sprayer base 160 and a deflector cap 162. The deflector cap 162 is mounted to the sprayer base 160 for axial movement in response to water pressure. The deflector cap 162 may be spring biased, or alternatively gravity biased, into a closed position to prevent ingress of debris which may clog the spray head and prevent operation. The spray base 160 includes a center aperture 164 that accepts a deflector cap mounting stem 166. The deflector mounting stem 166 has a length L that establishes a lift off height H of the deflector cap 162 relative to the sprayer base 160. The lift off height H is based on the diameter of the grain dryer 112, along with a minimum water deliver volume and pressure. The lift off height H is configured such that the water spray pattern is a generally horizontal spray pattern, as shown in FIG. 19, that reaches the interior wall 130 of the grain dryer 112. The water spray further has sufficient force and volume to both cascade down the interior wall 130 and penetrate through the exterior wall 132 into the grain columns 126. The water cascading along the interior wall 130 tends to draw heat away from the burning grain and lowers the amount of energy available to maintain or escalate combustion. The water that ingresses into the grain column 126 further dampens and extinguishes smoldering or burning material.

Figure 21:
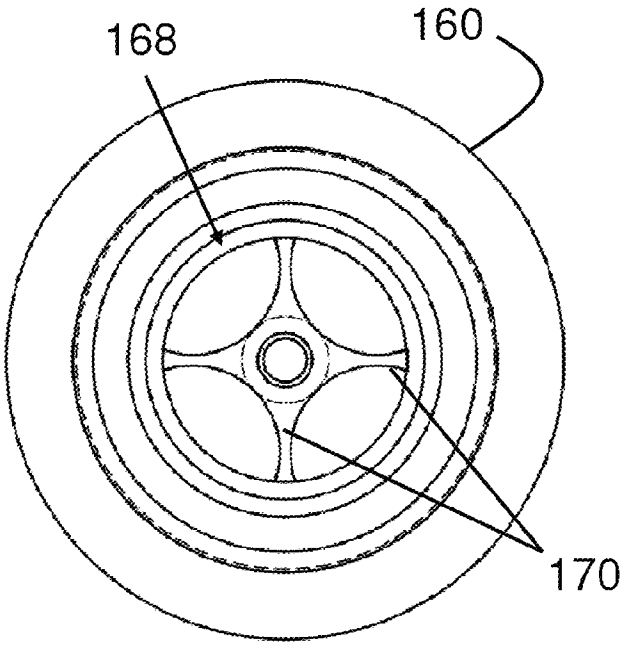
FIG. 21 is a plan view of the spray head of FIG. 20.

The spray base 160 includes a diffuser, shown generally at 168, that breaks up and directs the incoming water stream such that the water spray pattern is a generally horizontal spray pattern radiating 360 degrees within the dryer 112. As shown in FIG. 21, the diffuser 168 includes four fins 170 that define water flow quadrants. Though shown as having four fins, any suitable number of fins 170 may be used. When the water stream is separated into smaller discrete sections, the stream is easier to direct horizontally from a substantially vertical input flow to the spray head 160. Additionally, the spray pattern is generally evenly dispersed over the 360 degree area. The spray base 160 further includes an expanding tapered outlet 172 that permits the water to spray horizontally or generally in a radial direction toward the interior walls 130 of the grain columns 128.

While the invention has been described with reference to particular embodiments, it should be understood that various changes may be made and equivalents may be substituted for elements thereof without departing from the essential scope of the invention. In addition, many modifications may be made to adapt a particular situation or material to the teachings of the invention without departing from the essential scope thereof. Therefore, it is intended that the invention not be limited to the particular embodiments, but that the invention shall include all embodiments falling within the scope of the claims.

What is claimed is:

1. An internal staged suppression system for a grain dryer, the system comprising:

an inlet in fluid communication with a drainage elbow;

at least one vertical column section in fluid communication with the drainage elbow and a portion of the vertical column section extending along an exterior of a grain dryer and a portion extending in an interior of the grain dryer;

at least one horizontal column in fluid communication with the vertical column and linearly extending to a terminal end;

at least two spray heads, spaced vertically apart from each other;

wherein at least one of the spray heads is secured to the terminal end of the horizontal column and having a deflector cap that defines a lift off height, the lift off height being configured such that a water spray pattern is a generally horizontal spray pattern;

wherein the at least two spray heads are positioned in a generally radial center of the interior of the grain dryer, the generally horizontal water spray pattern being sufficient to cascade water over interior walls of a plurality of grain columns spaced around the grain dryer interior;

wherein the deflector cap is biased in a closed position relative to a spray base;

wherein the spray base includes a diffuser configured to divide an incoming water stream such that the generally horizontal water spray pattern is maintained; and wherein at least one of the spray heads is located in a generally radial center of a burner section of the grain dryer.

2. The internal staged suppression system of claim 1 wherein the lift off height is based on the diameter of the grain dryer, a minimum water deliver volume and a minimum water deliver pressure.

* * * * *